US007173585B2

(12) United States Patent
Weng

(10) Patent No.: US 7,173,585 B2
(45) Date of Patent: Feb. 6, 2007

(54) ACTIVE MATRIX DISPLAY DRIVING CIRCUIT

(75) Inventor: Ruey-Shing Weng, Kaohsiung (TW)

(73) Assignee: Wintek Corporation, Taichung (TW)

( * ) Notice: Subject to any disclaimer, the term of this patent is extended or adjusted under 35 U.S.C. 154(b) by 503 days.

(21) Appl. No.: 10/796,156

(22) Filed: Mar. 10, 2004

(65) Prior Publication Data

US 2005/0200572 A1 Sep. 15, 2005

(51) Int. Cl.
*G09G 3/32* (2006.01)

(52) U.S. Cl. ..... 345/82; 345/76

(58) Field of Classification Search ..... 345/76, 345/82; 315/169.1, 169.3
See application file for complete search history.

(56) References Cited

U.S. PATENT DOCUMENTS 6,229,506 B1 5/2001 Dawson et al.
6,359,605 B1 3/2002 Knapp et al.
6,373,454 B1 4/2002 Knapp et al.
6,501,466 B1 12/2002 Yamagishi et al.
6,535,185 B2 3/2003 Kim et al.
6,693,388 B2 * 2/2004 Oomura ..... 315/169.3
6,909,410 B2 * 6/2005 Kawasaki et al. ..... 345/82
2003/0112208 A1 * 6/2003 Okabe et al. ..... 345/82
2005/0068274 A1 * 3/2005 Lo ..... 345/82

OTHER PUBLICATIONS

Masuyuki Ohta et al., "9.4 Novel Current Programmed Pixel for Active Matrix OLED Displays", Research & Development Center, Toshibal Matsushita Display Technology Co., Ltd., Ishikawa, Japan, SID 03 Digest, p. 108-110, ISSN/0003-0966X/03/3401-0108.
Yang-Wan Kim et al., "A New Current Programmable Pixel Structure for Large-Size and High-Resolution AMOLEDs", Division of Electrial and Computer Engineering, Hanyang University, Seoul, Korea, R&D Center, Samsung SDI Co., Ltd, Suwon, Kyunggi-do, Korea, pp. 367-369, IDW '02.

* cited by examiner

*Primary Examiner*—Richard Hjerpe
*Assistant Examiner*—Kevin M. Nguyen
(74) *Attorney, Agent, or Firm*—Birch, Stewart, Kolasch & Birch, LLP

(57) ABSTRACT

An active matrix display driving circuit is disclosed. Each pixel driving circuit includes one luminance device, one transistor connected to the device, one driving transistor and one storage capacitor. There are two switching transistors at one end of the storage capacitor connecting to two voltage levels for capacitive coupling and gate voltage of the driving transistor is changed. This driving circuit is applicable to the current driving pixel circuit of Poly-Si TFT EL display panel, improves image defects resulting from uneven threshold voltage of a TFT and IR drop and solves charging/discharging time problems for low current import.

14 Claims, 8 Drawing Sheets

ACTIVE MATRIX DISPLAY DRIVING CIRCUIT

FIELD OF THE INVENTION

This invention relates to a driving circuit of electroluminescence device (EL device) is applicated in pixel of display. More particularly, the invention is directed to a driving device that improves the defect of images on an active matrix Poly-Si TFT EL device resulted from an inconsistent threshold voltage (Vth) and IR drop in addition to charging/discharging time problem.

BACKGROUND OF THE INVENTION

An EL device display can be classified according to its driving method, passive matrix (PM-EL Display) and active matrix (AM-EL Display). AM-EL display uses TFT (Thin Film Transistor) with a capacitor for storing data signals that can control EL display gray levels of brightness.

The manufacturing procedure of a PM-EL display is simpler in comparison and less costly; however, it is limited in its size (<5 inches) because of its driving mode and has a lower-resolution display application. In order to produce an EL display with higher resolution and larger size, utilizing active-matrix driving is necessary. The AM-EL uses TFT with a capacitor for storing data signals, so that the pixels can maintain their brightness after line scanning; on the other hand, pixels of passive matrix drive only light up when the scan line selects them. Therefore, with active matrix driving, the brightness of EL device is not necessarily ultra-bright, resulting in longer lifetime, higher efficiency and higher resolution. Naturally, EL devices with active matrix driving are suitable for display applications of a higher resolution and excellent picture quality.

LTPS (Low Temperature Poly-Silicon) and a-Si (Amorphous Silicon) are both technologies of TFT integrating on glass substrate. The obvious differences are electric characteristics and complexity of processing. Although LTPS-TFT possesses higher carrier mobility and higher mobility means more current can be supplied, the process is much more complex. However, the process of a-Si TFT is simpler and more mature, except for low carrier mobility. Therefore, a-Si process has better competitive advantage in cost.

Due to limitations of LTPS process capability, threshold voltage (Vth) and mobility of TFT elements produced vary leading to different properties of each TFT element. When the driving system achieves gray scale by analog voltage modulation, an EL device produces a different output current despite having the same data voltage signal input due to the different TFT characteristics of various pixels. Therefore, the luminance of an OLED varies. Images of erroneous gray scale will show up on OLED panel and seriously damage image uniformity.

The most urgent problem of the AM-EL display to be solved currently is how to reduce the impact of uneven LTPS-TFT characteristics. Such an issue requires an immediate solution for follow-up development and applications since images on the display tell the difference.

U.S. Pat. No. 6,373,454 discloses ⌈Active matrix electroluminescent display devices⌋ (Apr. 26, 2002), No. 6,229,506 discloses ⌈Active matrix light emitting diode pixel structure and concomitant method⌋ (May 26, 2001) and Toshiba publishes a thesis titled ⌈A Novel Current Programmed Pixel for Active Matrix OLED Displays⌋ (Society for Information Display 2003 (SID 2003)).

For the above patents and thesis, the input current on the data line and output current to the EL device was 1:1. Thus, there was a defect of long charge/discharge times for the capacitor and the parasitical capacitor at low current input.

U.S. Pat. No. 6,359,605 discloses ⌈Active matrix electroluminescent display devices⌋ (Mar. 26, 2002), U.S. Pat. No. 6,501,466 proposes ⌈Active matrix type display apparatus and drive circuit thereof⌋ (Dec. 26, 2002) and U.S. Pat. No. 6,535,185 presents ⌈Active driving circuit for display panel⌋ (Mar. 26, 2003).

For the aforementioned patents, the theory of current mirror is utilized to achieve the rate of input current and output current as n:1. However, two TFTs in the current mirror have to be matched to prevent threshold voltage (Vth) difference and mobility. Thus, requirements for TFT manufacturing process are stricter.

The common problem for the circuits above is the voltage discharged from the storage capacitor to the gate and source of the driving transistor (Vgs) has to be less than the threshold voltage (Vth) of the driving transistor. Nevertheless, Vgs is larger than Vth due to long discharging time. Consequently, EL device illuminates via a small current and therefore the contrast of the display panel is not good.

A thesis with the subject of ⌈A New Current Programmable Pixel Structure for large-Size and High-Resolution AMOLEDs⌋ is released by Samsung (International Display Workshops 2002 (IDW 2002)). The theory of capacitive coupling is applied to change the gate voltage (Vg) of the driving TFT to establish a relationship between the output and input currents as output current=A×input current+B (A and B are constants). As capacitors are affected by the process or the layout, the voltage of capacitive coupling changes and the output current of the driving transistor is influenced, too. Defects of this driving method are capacitance precision and impose strict requirements for capacitor processing and layout. In addition, the aperture ratio of pixels becomes smaller as two capacitors are required to drive one pixel.

SUMMARY OF THE INVENTION

The main purpose of this invention is to solve the said problems. This invention not only improves image defects resulting from uneven characteristics of TFT and IR drop, but also solves the problem of long charge/discharge times for low current inputs.

To achieve the objective above, every pixel on the display panel comprises one scan line and one data line. A driving device of each pixel includes a first scan transistor and a second scan transistor, whose gates (G) are connected to scan line and sources (S) connected to data line. A driving transistor is also included and connected to the voltage supply line.

The source (S) of connect transistor is connected to the drains (D) of the driving transistor and the second scan transistor and the gate (G) is connected to emission line.

The source (S) of first switch transistor is connected to the first voltage supply and the gate is connected to the scan line; the source (S) of second switch transistor is connected to second voltage supply and the gate (G) is connected to the emission line.

One end of storage capacitor connects to the drains (D) of the first and second switch transistors and the other end is connected to the drain (D) of the first scan transistor and the gate (G) of the driving transistor. The anode of luminescence element is connected to the drain of the connect transistor and the cathode is grounded. All transistors are PMOS transistors and the voltage of the second voltage supply is greater than that of the first voltage supply.

The first voltage supply can connect to the emission line and the second voltage supply connect to the scan line; alternatively, the first voltage supply can connect to the voltage supply; or, the first voltage supply can connect to the voltage supply and the second voltage supply connects to the scan line.

Another embodiment is to change all transistors to NMOS, and the driving circuit includes a first scan transistor and a second scan transistor, whose gates (G) connect to the scan line and sources (S) are connect to the data line. One driving transistor is also included, with the source (S) grounded. One connect transistor is included, with its source (S) connected to the drains (D) of the driving transistor and the first scan transistor and the gate (G) connected to one emission line.

The source (S) of one first switch transistor is connected to one first voltage supply and the gate (G) is connected to the scan line; the source (S) of the second switch transistor is connected to second voltage supply and the gate (G) is connected to the emission line.

One end of one storage capacitor connects to the drains (D) of the first and second switch transistors and the other end is connected to the drain (D) of the second scan transistor and the gate (G) of the driving transistor. The anode of one luminescence element is connected to the voltage supply and the cathode is connected to the drain (D) of the connect transistor.

The same as the above driving circuit, the first voltage supply may be connected to the emission line and the second voltage supply connected to the scan line; alternatively, only the first voltage supply is grounded; or, the first voltage supply is grounded and the second voltage supply is connected to the scan line.

DETAILED DESCRIPTION OF THE PREFERRED EMBODIMENTS

Embodiment 1

Figure 1:
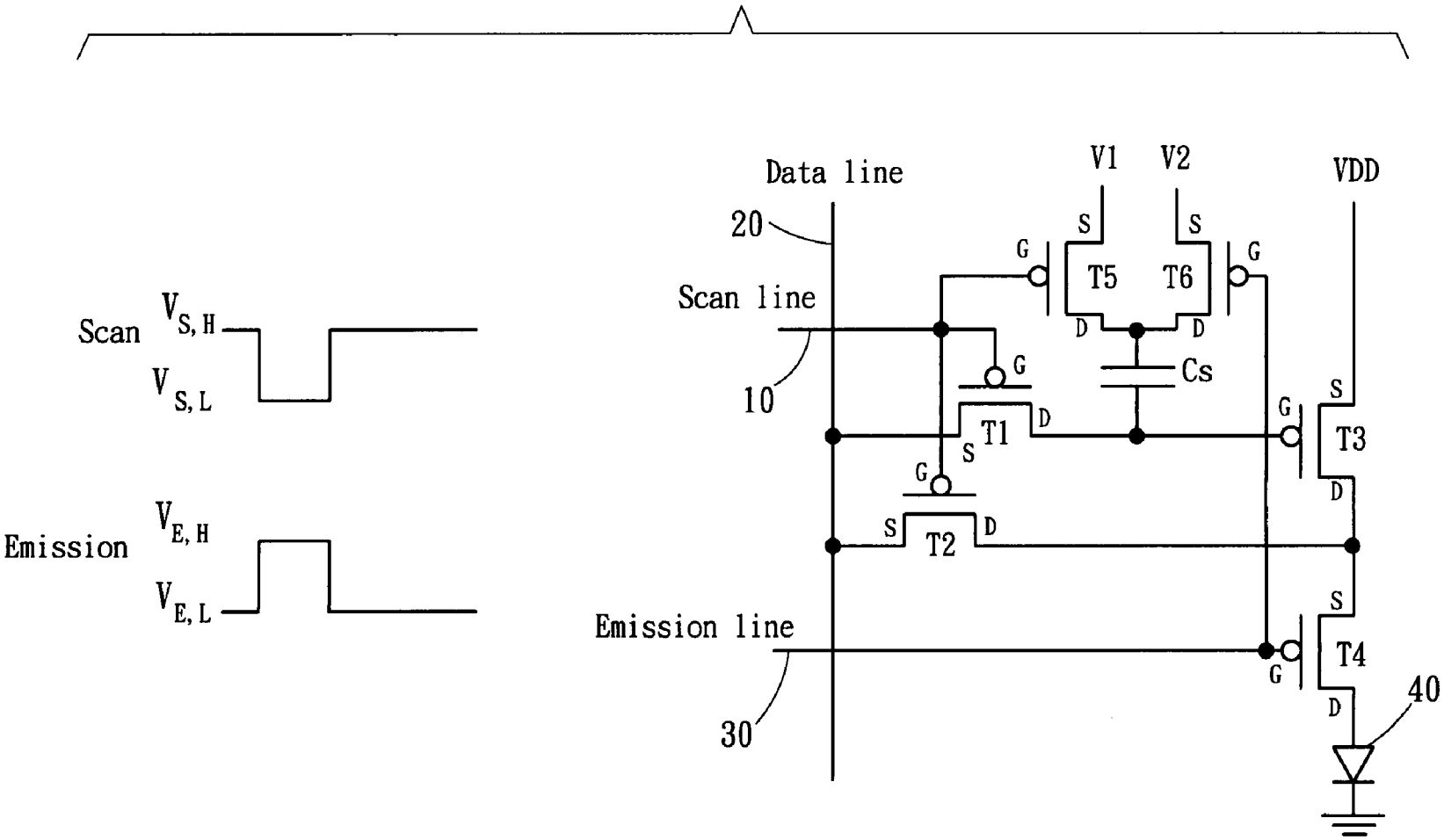
FIG. 1 is the circuit of a pixel in embodiment 1 in this invention.

Refer to FIG. 1 for the circuit of a pixel of embodiment 1 in this invention. As the Figure shows: the driving circuit of each pixel on the display panel includes one scan line 10 and one data line 20 as follows:

Gates (G) of a first scan transistor TI and a second scan transistor T2 connected to one scan line 10 and source (S) connected to a data line 20.

Source (S) of a driving transistor T3 connected to VDD. Source (S) of connect transistor T4 connected to drains (D) of driving transistor T3 and second scan transistor T2 and gate (G) connected to one emission line 30.

Source (S) of a first switch transistor T5 connected to first voltage supply V1 and gate (G) connected to scan line 10. Source (S) of a second switch transistor T6 connected to second voltage supply V2 and gate (G) connected to emission line 30. The above first scan transistor T1, second scan transistor T2, driving transistor T3, connect transistor T4, first switch transistor T5 and second switch transistor T6 are PMOS transistors. One end of storage capacitor Cs connected to drains (D) of the first switch transistor T5 and second switch transistor T6 and the other end connected to drain (D) of first scan transistor T1 and gate (G) of driving transistor T3. Anode of a luminescence device 40 connected to drain (D) of connect transistor T4 and cathode grounded. Luminescence device 40 is an electro-luminescence device (EL device).

Gates (G) of first scan transistor TI and second scan transistor T2 controlled by nth Scan Line 10 and sources connected to data line 20.

Gate (G) of connect transistor T4 controlled by nth emission line 30. Current passing by luminescence device 40 determined by gate (G) of driving transistor T3.

Gate (G) of first switch transistor T5 controlled by nth scan line 10 and that of second switch transistor T6 controlled by nth emission line 30.

Actuation procedures of this invention are described as follows:

1. When the system scans the nth scan line 10, the potential is low ($V_{S,L}$), leading first scan transistor T1, second scan transistor T2 and first switch transistor T5 to become on. As the potential of the nth emission line 30 is high ($V_{E,H}$), connect transistor T4 and second switch transistor T6 are off. Thus, no current will pass through luminescence device 40 to prevent writing mistakes of storage capacitor Cs.

One end of storage capacitor Cs connected to gate (G) of driving transistor T3 links up with data line 20 through scan transistor T1 and the other end is connected to first voltage supply V1 via first switch transistor T5. Meanwhile, part of data current $I_{Data}$ charges/discharges storage capacitor Cs through first scan transistor T1 and first switch transistor T5. Gate voltage ($V_{g3}$) of driving transistor T3 equals voltage of first voltage supply V1 less that of storage capacitor Cs ($V1-V_{CS}$).

Consequently, drive current ($I_{Drive}$) passing through driving transistor T3 is as follows: $I_{Drive}=(1/2)\times\beta\times(V_{sg3}-V_{th3})^2$ ($\beta$ as trans-conductance parameter of driving transistor T3 and source gate voltage of driving transistor T3, $V_{sg3}=VDD-V_{g3}=VDD-(V1-V_{CS})$. At present, data current $I_{Data}$ equals current passing through storage capacitor Cs ($I_{CS}$) plus drive current ($I_{Drive}$) passing through driving transistor T3; i.e., $I_{Data}=I_{CS}+I_{Drive}$.

2. Voltage of storage capacitor Cs ($V_{CS}$) makes drive current ($I_{Drive}$) passing through driving transistor T3 the same as data current of data line 20; that is, $I^{Data}=I_{Drive}=(1/2)\times\beta\times(V_{sg3}-V_{th3})^2$ and $V_{sg3}=VDD-V_{g3}=VDD-(V1-V_{CS})$.

Data write is completed at the moment and voltage of storage capacitor Cs $(V_{CS})=(2\times I_{Data}/\beta)^{(1/2)}-(VDD-V1-V_{th3})$.

3. Lastly, when potential of the nth Scan Line 10 changes from low ($V_{S,L}$) to high ($V_{S,H}$), First scan transistor T1, second scan transistor T2 and first switch transistor T5 are off. Meanwhile, potential of the nth Emission line 30 changes from high ($V_{E,H}$) to low ($V_{E,L}$), leading connect transistor T4 and second switch transistor T6 to become on.

One end of storage capacitor Cs is connected to gate (G) of driving transistor T3 and the other end to second voltage supply V2 via second switch transistor T6. Thus, gate voltage $V_{g3}$ of driving transistor T3 equals voltage of second voltage supply V2 less that of storage capacitor Cs; i.e., $V_{g3}=V2-V_{CS}$.

Drive current passing through driving transistor T3 is as follows: $I_{Drive}=(1/2)\times\beta\times(V_{sg3}-V_{th3})^2$ and $V_{sg3}=VDD-V_{g3}=VDD-(V2-V_{CS})$. Luminescence device 40 is illuminated as drive current ($I_{Drive}$) passes through it via connect transistor T4.

In summary, the relationship between data current ($I_{Data}$) and drive current ($I_{Drive}$) is shown as $I_{Drive}=(1/2)\times\beta\times[(2\times I_{Data}/\beta)^{(1/2)}+V1-V2]^2$.

According to the above theory and formula, current output to luminescence device 40 is only related to data current ($I_{Data}$) written, not threshold voltage (Vth) of driving transistor T3. As a result, threshold voltage difference resulted from process factors can be compensated.

Voltage difference between first voltage supply V1 and second voltage supply V2 causes an offset at gate (G) voltage ($V_{g3}$) of driving transistor T3. If voltage of second voltage supply V2 is greater than that of first voltage supply V1, larger data current ($I_{Data}$) may be imported by small drive current ($I_{Drive}$) at low gray scale to reduce charging time of storage capacitor Cs and parasitical capacitor.

Embodiment 2

Figure 2:
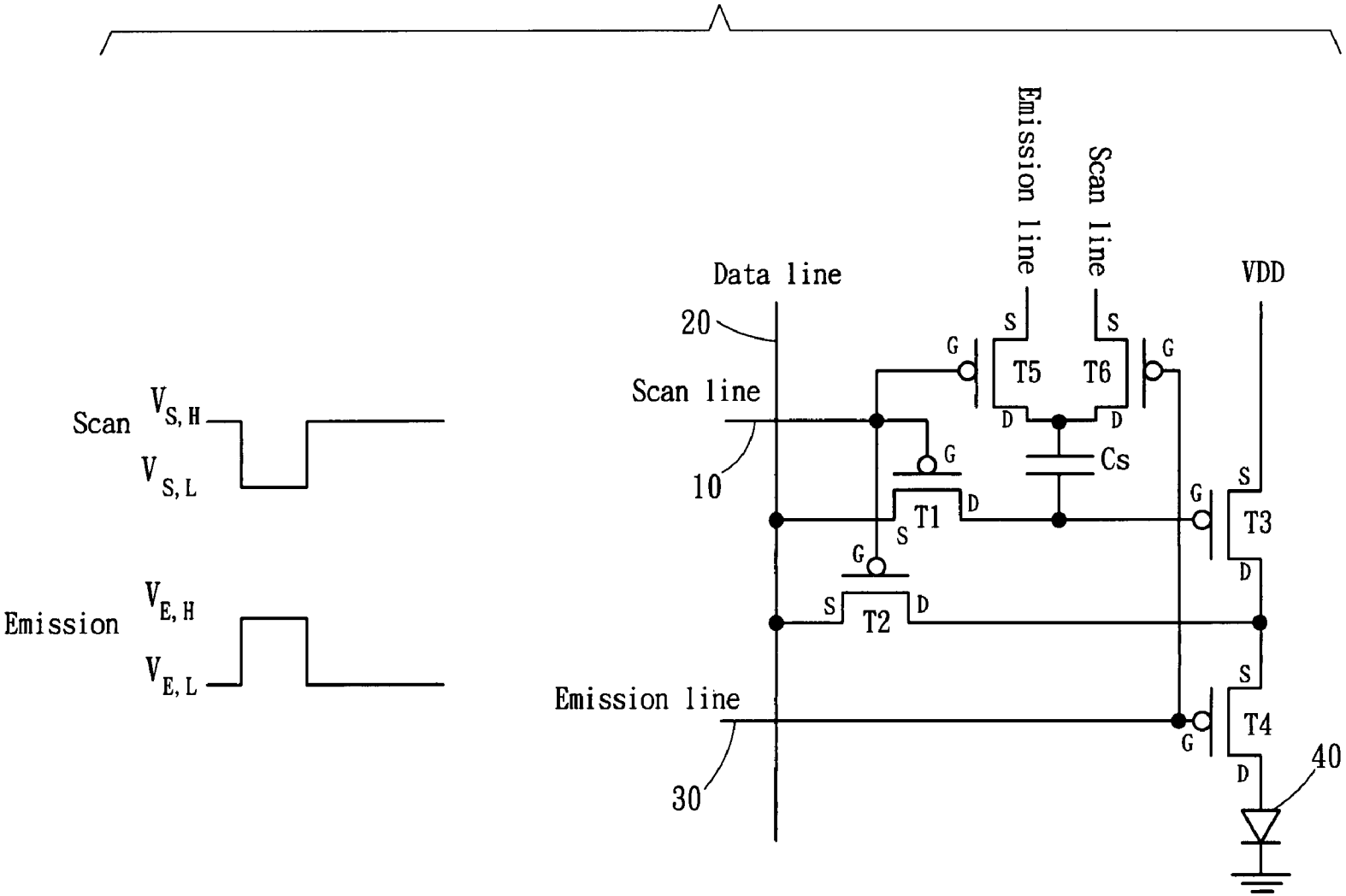
FIG. 2 is the circuit of a pixel in embodiment 2 in this invention.

Refer to FIG. 2 for the circuit of a pixel of embodiment 2 in this invention. As the Figure shows, the driving circuit of each pixel on the display panel includes one scan line 10 and one data line 20. The driving circuit in this embodiment is about the same as that in Embodiment 1; however, the only difference is source (S) of first switch transistor T5 connected to emission line 30 instead of first voltage supply V1 and source (S) of second switch transistor T6 connected to scan line 10, not second voltage supply V2.

Actuation procedures of Embodiment 2 are described as follows:

1. When the system scans the nth scan line 10, the potential is low ($V_{S,L}$), leading first scan transistor T1, second scan transistor T2 and first switch transistor T5 to become on. As the potential of the nth emission line 30 is high ($V_{E,H}$), connect transistor T4 and second switch transistor T6 are off. Thus, no current will pass through luminescence device 40 to prevent writing mistakes to the storage capacitor Cs.

One end of storage capacitor Cs connected to gate (G) of driving transistor T3 links up with data line 20 through first scan transistor T1 and the other end is connected to nth emission line 30 via first switch transistor T5. Meanwhile, part of data current ($I_{Data}$) charges/discharges storage capacitor Cs through first scan transistor T1 and first switch transistor T5. Gate voltage ($V_{g3}$) of driving transistor T3 equals voltage of emission line 30 ($V_{E,H}$) less that of storage capacitor Cs ($V_{E,H}-V_{CS}$).

Consequently, drive current ($I_{Drive}$) passing through driving transistor T3 is as follows: $I_{Drive}=(1/2)\times\beta\times(V_{sg3}-V_{th3})^2$ ($\beta$ as trans-conductance parameter of driving transistor T3 and source gate voltage of driving transistor T3, $V_{sg3}=VDD-V_{g3}=VDD-(V_{E,H}-V_{CS})$). Hence, data current $I_{Data}$ equals current passing through storage capacitor Cs ($I_{CS}$) plus drive current ($I_{Drive}$) passing through driving transistor T3; i.e., $I_{Data}=I_{CS}+I_{Drive}$.

2. Voltage of storage capacitor Cs ($V_{CS}$) makes drive current ($I_{Drive}$) passing through driving transistor T3 the same as data current ($I_{Data}$) of data line 20; that is, $I_{Data}=I_{Drive}=(1/2)\times\beta\times(V_{sg3}-V_{th3})^2$ and $V_{sg3}=VDD-V_{g3}=VDD-(V_{E,H}-V_{CS})$.

Data write is completed at the moment and voltage of storage capacitor Cs ($V_{CS}$)$=(2\times I_{Data}/\beta)^{(1/2)}-(VDD-V_{E,H}-V_{th3})$.

3. Lastly, when the potential of the nth scan line 10 changes from low ($V_{S,L}$) to high ($V_{S,H}$), first scan transistor T1, second scan transistor T2 and first switch transistor T5 are OFF. Meanwhile, potential of the nth emission line 30 changes from high ($V_{E,H}$) to low ($V_{E,L}$), leading connect transistor T4 and second switch transistor T6 are ON.

One end of storage capacitor Cs is connected to gate (G) of driving transistor T3 and the other end to scan line 10 via second switch transistor T6. Thus, gate voltage $V_{g3}$ of driving transistor T3 equals voltage of scan line 10 at high potential ($V_{S,H}$) less that of storage capacitor Cs; i.e., $V_{g3}=V_{S,H}-V_{cs}$.

Drive current passing through driving transistor T3 is as follows: $I_{Drive}=(1/2)\times\beta\times(V_{sg3}-V_{th3})^2$ and $V_{sg3}=VDD-V_{g3}=VDD-(V_{S,H}-V_{CS})$. Luminescence device 40 is illuminated as drive current ($I_{Drive}$) passes through it via connect transistor T4.

In summary, the relationship between data current ($I_{Data}$) and drive current ($I_{Drive}$) is shown as $I_{Drive}=(1/2)\times\beta\times[(2\times I_{Data}/\beta)^{(1/2)}+V_{E,H}-V_{S,H}]^2$.

According to the above theory and formula, current output to luminescence device 40 is only related to data current ($I_{Data}$) written, not threshold voltage (Vth) of driving transistor T3. As a result, threshold voltage difference resulting from processing factors can be compensated for.

In addition, voltage differences between scan line 10 ($V_{S,H}$) high level voltage and emission line 30 ($V_{E,H}$) high level voltage causes an offset at gate (G) voltage ($V_{g3}$) of driving transistor T3. If potential of scan line 10 ($V_{S,H}$) is higher than that of emission line 30 ($V_{E,H}$), greater data current ($I_{Data}$) may be imported by small drive current ($I_{Drive}$) at low gray scale to reduce charging time of storage capacitor Cs and parasitical capacitor.

Embodiment 3

Figure 3:
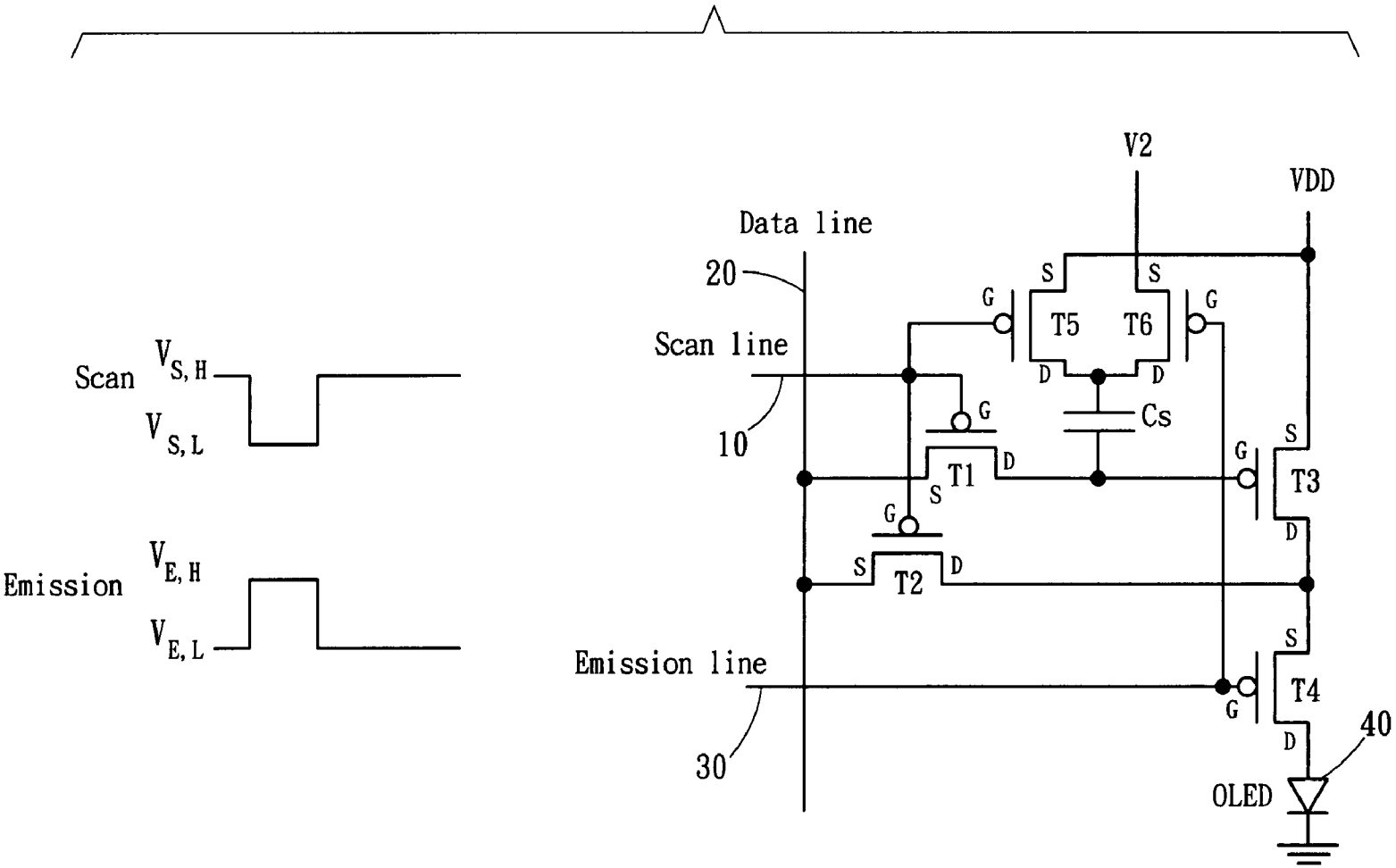
FIG. 3 is the circuit of a pixel in embodiment 3 in this invention.

Refer to FIG. 3 for the circuit of a pixel of embodiment 3 in this invention. As the Figure shows, the driving circuit of each pixel on the display panel includes one scan line 10 and one data line 20. The driving circuit in this embodiment is about the same as that in Embodiment 1; however, the only difference is the source (S) of first switch transistor T5 is connected to voltage supply VDD instead of First voltage supply V1 and source (S) of second switch transistor T6 still connected to second voltage supply V2 as in Embodiment 1.

Actuation procedures of Embodiment 3 are described as follows:

1. When the system scans the nth scan line 10, the potential is low ($V_{S,L}$), leading first scan transistor T1, second scan transistor T2 and first switch transistor T5 to become on. As the potential of the nth emission line 30 is high ($V_{E,H}$), connect transistor T4 and second switch transistor T6 are off. Thus, no current will pass through luminescence device 40 to prevent writing mistakes of storage capacitor Cs.

One end of storage capacitor Cs connected to gate of driving transistor T3 links up with data line 20 through scan transistor T1 and the other end is connected to voltage supply VDD via first switch transistor T5. Meanwhile, part of data current ($I_{Data}$) charges/discharges storage capacitor Cs through first scan transistor T1 and first switch transistor T5. Gate voltage ($V_{g3}$) of driving transistor T3 equals voltage of voltage supply VDD less that of storage capacitor Cs ($VDD-V_{CS}$).

Consequently, drive current ($I_{Drive}$) passing through driving transistor T3 is as follows: $I_{Drive}=(1/2)\times\beta\times(V_{sg3}-V_{th3})^2$ (β as trans-conductance parameter of driving transistor T3 and source gate voltage of driving transistor T3, $V_{sg3}=VDD-V_{g3}=VDD-(VDD-V_{CS})$. Hence, data current ($I_{Data}$) equals current passing through storage capacitor Cs ($I_{CS}$) plus drive current ($I_{Drive}$) passing through driving transistor T3; i.e., $I_{Data}=I_{CS}+I_{Drive}$.

2. Voltage of storage capacitor Cs ($V_{CS}$) makes drive current ($I_{Drive}$) passing through driving transistor T3 the same as data current ($I_{Data}$) of data line 20; that is, $I_{Data}=I_{Drive}=(1/2)\times\beta\times(V_{sg3}-V_{th3})^2$ and $V_{sg3}=VDD-V_{g3}=VDD-(VDD-V_{CS})$.

Data write is completed at the moment and voltage of storage capacitor Cs ($V_{CS}$)=$(2\times I_{Data}/\beta)^{(1/2)}-(VDD-VDD-V_{th3})$.

3. Last, when potential of the nth scan line 10 changes from low ($V_{S,L}$) to high ($V_{S,H}$), first scan transistor T1, second scan transistor T2 and first switch transistor T5 are off. Meanwhile, potential of the nth emission line 30 changes from high ($V_{E,H}$) to low ($V_{E,L}$), leading connect transistor T4 and second switch transistor T6 to become on.

One end of storage capacitor Cs is connected to gate of driving transistor T3 and the other end to second voltage supply V2 via second switch transistor T6. Thus, gate voltage ($V_{g3}$) of driving transistor T3 equals voltage of second voltage supply V2 less that of storage capacitor Cs; i.e., $V_{g3}=V2-V_{cs}$.

Drive current passing through driving transistor T3 is as follows: $I_{Drive}=(1/2)\times\beta\times(V_{sg3}-V_{th3})^2$ and $V_{sg3}=VDD-V_{g3}=VDD-(V2-V_{CS})$. Luminescence device 40 is illuminated as drive current ($I_{Drive}$) passes through it via connect transistor T4.

In summary, the relationship between data current ($I_{Data}$) and drive current ($I_{Drive}$) is shown as $I_{Drive}=(1/2)\times\beta\times[(2\times I_{Data}/\beta)^{(1/2)}+VDD-V2]^2$.

According to the above theory and formula, current output to luminescence device 40 is only related to data current ($I_{Data}$) written, not threshold voltage (Vth) of driving transistor T3. As a result, threshold voltage difference resulted from process factors can be compensated.

In addition, voltage difference between voltage supply VDD and second voltage supply V2 causes an offset at the gate (G) of driving transistor T3. If voltage of second voltage supply V2 is greater than that of voltage supply VDD, larger data current ($I_{Data}$) may be imported by small drive current ($I_{Drive}$) at low gray scale to reduce charging time of storage capacitor Cs and parasitical capacitor.

Embodiment 4

Figure 4:
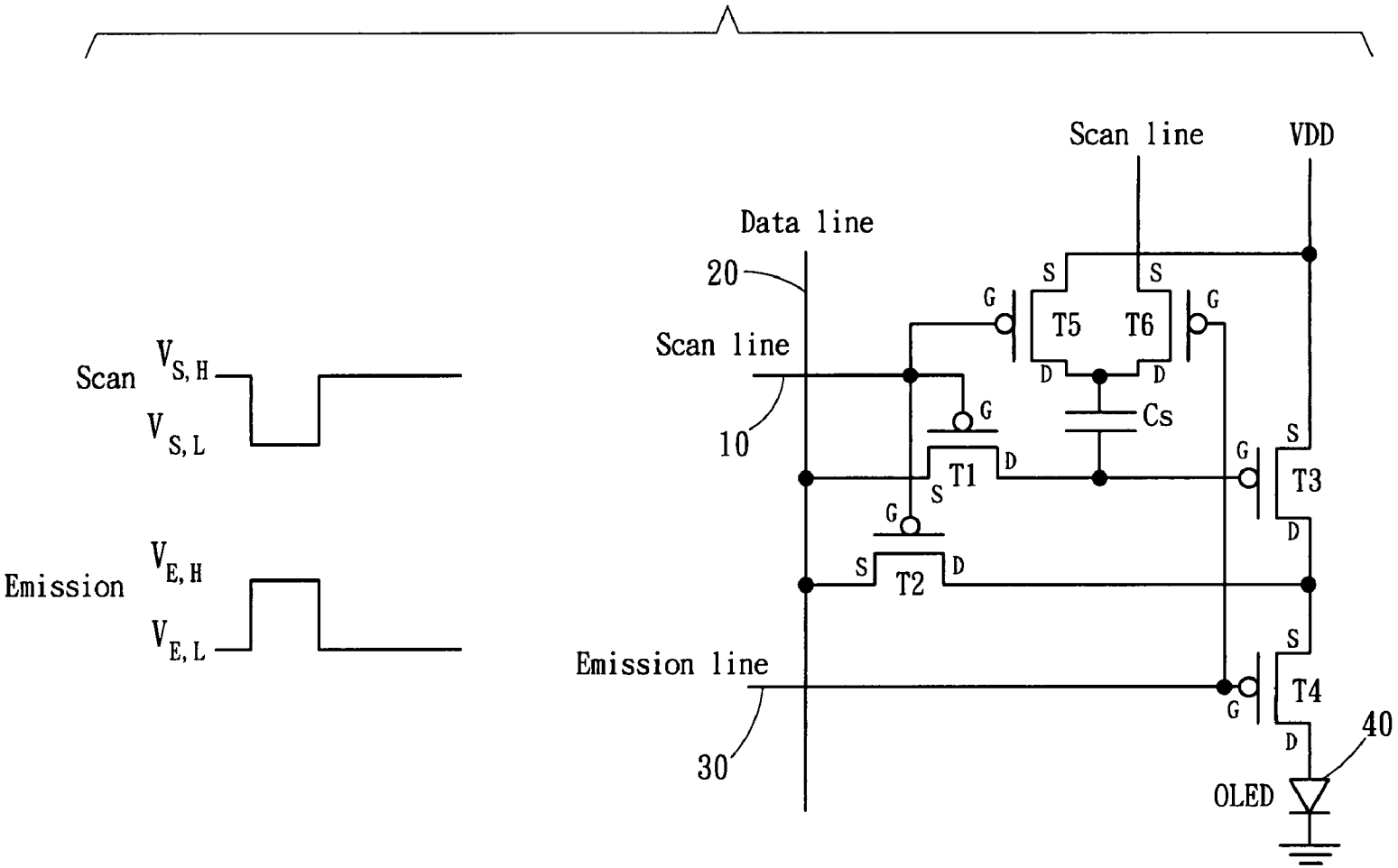
FIG. 4 is the circuit of a pixel in embodiment 4 in this invention.

Refer to FIG. 4 for the circuit of a pixel of embodiment 4 in this invention. As the Figure shows, the driving circuit of each pixel on the display panel includes one scan line 10 and one data line 20. The driving circuit in this embodiment is about the same as that in Embodiment 2; however, the only difference is source (S) of first switch transistor T5 connected to voltage supply VDD instead of emission line 30 and source (S) of second switch transistor T6 still connected to scan line 10.

Actuation procedures of Embodiment 4 are described as follows:

1. When the systems scans the nth scan line 10, the potential is low ($V_{S,L}$), leading first scan transistor T1, second scan transistor T2 and first switch transistor T5 to become on. As the potential of the nth emission line 30 is high ($V_{E,H}$), connect transistor T4 and second switch transistor T6 are OFF. Thus, no current will pass through luminescence device 40 to prevent writing mistakes of storage capacitor Cs.

One end of storage capacitor Cs connected to gate (G) of driving transistor T3 links up with data line 20 through scan transistor T1 and the other end is connected to voltage supply VDD via first switch transistor T5. Meanwhile, part of data current ($I_{Data}$) charges/discharges storage capacitor Cs through first scan transistor T1 and first switch transistor T5. Gate voltage ($V_{g3}$) of driving transistor T3 equals voltage of voltage supply VDD less that of storage capacitor Cs ($VDD-V_{CS}$).

Consequently, drive current ($I_{Drive}$) passing through driving transistor T3 is as follows: $I_{Drive}=(1/2)\times\beta\times(V_{sg3}-V_{th3})^2$ (β as trans-conductance parameter of driving transistor T3 and source gate voltage of driving transistor T3, $V_{sg3}=VDD-V_{g3}=VDD-(VDD-V_{CS})$. Hence, data current ($I_{Data}$) equals current passing through storage capacitor Cs ($I_{CS}$) plus drive current ($I_{Drive}$) passing through driving transistor T3; i.e., $I_{Data}=I_{CS}+I_{Drive}$.

2. Voltage of storage capacitor Cs ($V_{CS}$) makes drive current ($I_{Drive}$) passing through driving transistor T3 the same as data current ($I_{Data}$) of data line 20; that is, $I_{Data}=I_{Drive}=(1/2)\times\beta\times(V_{sg3}-V_{th3})^2$ and $V_{sg3}=VDD-V_{g3}=VDD-(VDD-V_{CS})$.

Data write is completed at the moment and voltage of storage capacitor Cs ($V_{CS}$)=$(2\times I_{Data}/\beta)^{(1/2)}-(VDD-VDD-Vth_3)$.

3. Last, when potential of the nth scan line 10 changes from low ($V_{S,L}$) to high ($V_{S,H}$), first scan transistor T1, second scan transistor T2 and first switch transistor T5 are off. Meanwhile, potential of the nth emission line 30 changes from high ($V_{E,H}$) to low ($V_{E,L}$), leading connect transistor T4 and second switch transistor T6 to become on.

One end of storage capacitor Cs is connected to gate (G) of driving transistor T3 and the other end to scan line 10 via second switch transistor T6. Thus, gate voltage ($V_{g3}$) of driving transistor T3 equals voltage of scan line 10 at high ($V_{S,H}$) less that of storage capacitor Cs; i.e., $V_{g3}=V_{S,H}-V_{cs}$.

Drive current passing through driving transistor T3 is as follows: $I_{Drive}=(1/2)\times\beta\times(V_{sg3}-V_{th3})^2$ and $V_{sg3}=VDD-V_{g3}=VDD-(V_{S,H}-V_{CS})$. Luminescence device 40 is illuminated as drive current ($I_{Drive}$) passes through it via connect transistor T4.

In summary, the relationship between data current ($I_{Data}$) and drive current ($I_{Drive}$) is shown as $I_{Drive}=(1/2)\times\beta\times[(2\times I_{Data}/\beta)^{(1/2)}+VDD-V_{S,H}]^2$.

According to the above theory and formula, current output to luminescence device 40 is only related to data current ($I_{Data}$) written, not threshold voltage (Vth) of driving transistor T3. As a result, threshold voltage difference resulting from processing factors can be compensated.

In addition, voltage differences between voltage supply VDD and scan line 10 high level voltage causes an offset at the gate (G) of driving transistor T3. If the voltage of scan line 10 ($V_{S,H}$) is greater than that of voltage supply VDD, larger data current ($I_{Data}$) may be imported by small drive current ($I_{Drive}$) at low gray scale to reduce charging time of storage capacitor Cs and parasitical capacitor.

Embodiment 5

Figure 5:
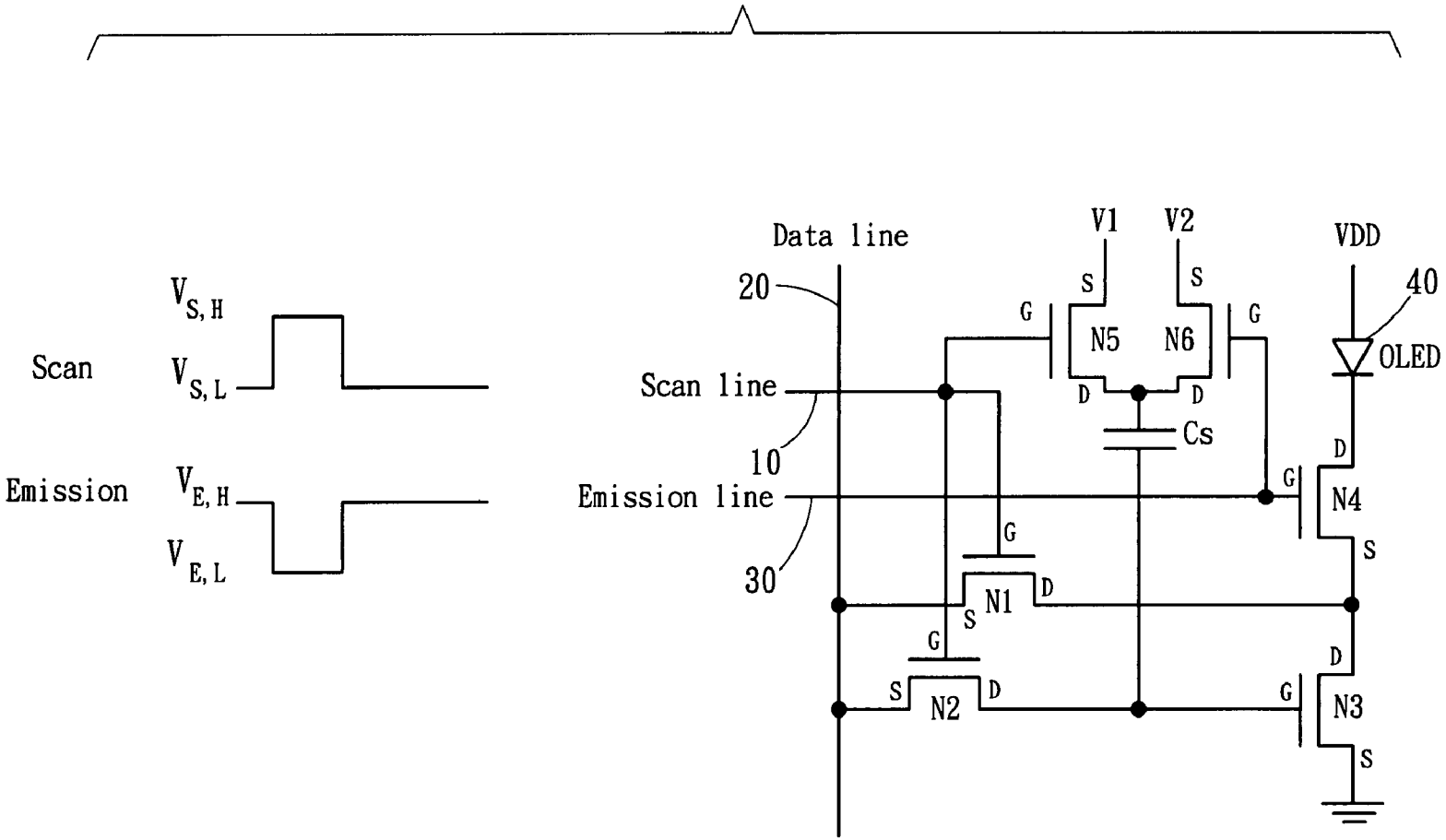
FIG. 5 is the circuit of a pixel in embodiment 5 in this invention.

Refer to FIG. 5 for the circuit of a pixel of embodiment 5 in this invention. As the Figure shows, the driving circuit of each pixel on the display panel includes one scan line 10 and one data line 20 as follows:

Gates (G) of a first scan transistor N1 and a second scan transistor N2 connected to one scan line 10 and source (S) connected to a data line 20.

Source (S) of a driving transistor N3 is grounded. Source (S) of one connect transistor N4 connected to drains (D) of driving transistor N3 and first scan transistor N1 and gate (G) connected to one emission line 30.

Source (S) of a first switch transistor N5 connected to first voltage supply V1 and gate (G) connected to scan line 10. Source (S) of a second switch transistor N6 connected to second voltage supply V2 and gate (G) connected to emission line 30. The above first scan transistor N1, second scan transistor N2, driving transistor N3, connect transistor N4, first switch transistor N5 and second switch transistor N6 are NMOS transistors.

One end of the storage capacitor Cs is connected to the drains of the first switch transistor N5 and second switch transistor N6 and the other end connected to drain (D) of second scan transistor N1 and gate (G) of driving transistor N3. Anode of a luminescence device 40 connected to voltage supply VDD and cathode connected to drain of connect transistor N4. Luminescence device 40 is an electro-luminescence device (EL device).

Gate (G) of connect transistor N4 controlled by nth emission line 30 and current passing through luminescence device 40 determined by gate (G) voltage of driving transistor N3.

Gate (G) of first switch transistor N5 also controlled by nth scan line 10. Gate(G) of second switch transistor N6 controlled by nth emission line 30.

It is different from Embodiment 1 in that one end of luminescence device 40 is connected to voltage supply VDD and the other end to connect transistor N4. Furthermore, first scan transistor N1, second scan transistor N2, driving transistor N3, connect transistor N4, first switch transistor N5 and second switch transistor N6 are NMOS transistors.

Actuation procedures of Embodiment 5 are described as follows:

1. When the systems scans the nth scan line 10, the potential is high ($V_{S,H}$), leading first scan transistor N1, second scan transistor N2 and first switch transistor N5 to become on. As the potential of the nth emission line 30 is low ($V_{E,L}$), connect transistor N4 and second switch transistor N6 are off. Thus, no current will pass through luminescence device 40 to prevent writing mistakes to the storage capacitor Cs.

One end of storage capacitor Cs connected to gate of driving transistor N3 links up with data line 20 through second scan transistor N2 and the other end is connected to first voltage supply V1 via first switch transistor N5. Meanwhile, part of data current ($I_{Data}$) of data line 20 charges/discharges storage capacitor Cs through first scan transistor N1 and first switch transistor N5. Gate voltage ($V_{g3}$) of driving transistor N3 equals voltage of first voltage supply V1 less that of storage capacitor Cs ($V1+V_{CS}$).

Consequently, drive current ($I_{Drive}$) passing through driving transistor N3 is as follows: $I_{Drive}=(1/2)\times\beta\times(V_{gs3}-V_{th3})^2$ (β as trans-conductance parameter of driving transistor N3 and source gate voltage of driving transistor N3, $V_{gs3}=V_{g3}=V1+V_{CS}$). Hence, data current ($I_{Data}$) equals current passing through storage capacitor Cs ($I_{CS}$) plus drive current ($I_{Drive}$) passing through driving transistor N3; i.e., $I_{Data}=I_{CS}+I_{Drive}$.

2. Voltage of storage capacitor Cs ($V_{CS}$) makes drive current ($I_{Drive}$) passing through driving transistor N3 the same as data current ($I_{Data}$) of data line 20; that is, $I^{Data}=I_{Drive}=(1/2)\times\beta\times(V_{gs3}-V_{th3})^2$ and $V_{gs3}=V_{g3}=V1+V_{CS}$. Data write is completed at the moment and voltage of storage capacitor Cs $(V_{CS})=(2\times I_{Data}/\beta)^{(1/2)}-(V1-V_{th3})$.

3. Last, when potential of the nth scan line 10 changes from high ($V_{S,H}$) to low ($V_{S,L}$), first scan transistor N1, second scan transistor N2 and first switch transistor N5 are off. Meanwhile, potential of the nth emission line 30 changes from low ($V_{E,L}$) to high ($V_{E,H}$), leading connect transistor N4 and second switch transistor N6 to ON.

One end of storage capacitor Cs is connected to gate of driving transistor N3 and the other end to second voltage supply V2 via second switch transistor N6. Thus, gate (G) voltage ($V_{g3}$) of driving transistor N3 is $V2+V_{Cs}$. Drive current passing through driving transistor N3 is as follows: $I_{Drive}=(1/2)\times\beta\times(V_{gs3}-V_{th3})^2$ and $V_{gs3}=V_{g3}=V2+V_{CS}$. Luminescence device 40 is illuminated as drive current ($I_{Drive}$) passes through it via connect transistor N4.

In summary, the relationship between data current ($I_{Data}$) and drive current ($I_{Drive}$) is shown as $I_{Drive}=(1/2)\times\beta\times[(2\times I_{Data}/\beta)^{(1/2)}+V2-V1]^2$.

According to the above theory and formula, current output to luminescence device 40 is only related to data current ($I_{Data}$) written, not threshold voltage (Vth) of driving transistor N3. As a result, threshold voltage difference resulted from process factors can be compensated.

In addition, voltage difference between second voltage supply V2 and first voltage supply V1 causes an offset at the gate of driving transistor N3. If voltage of second voltage supply V2 is less than that of first voltage supply V1, larger data current ($I_{Data}$) may be imported by small drive current ($I_{Drive}$) at low gray scale to reduce the long charging time of storage capacitor Cs and parasitical capacitor.

Embodiment 6

Figure 6:
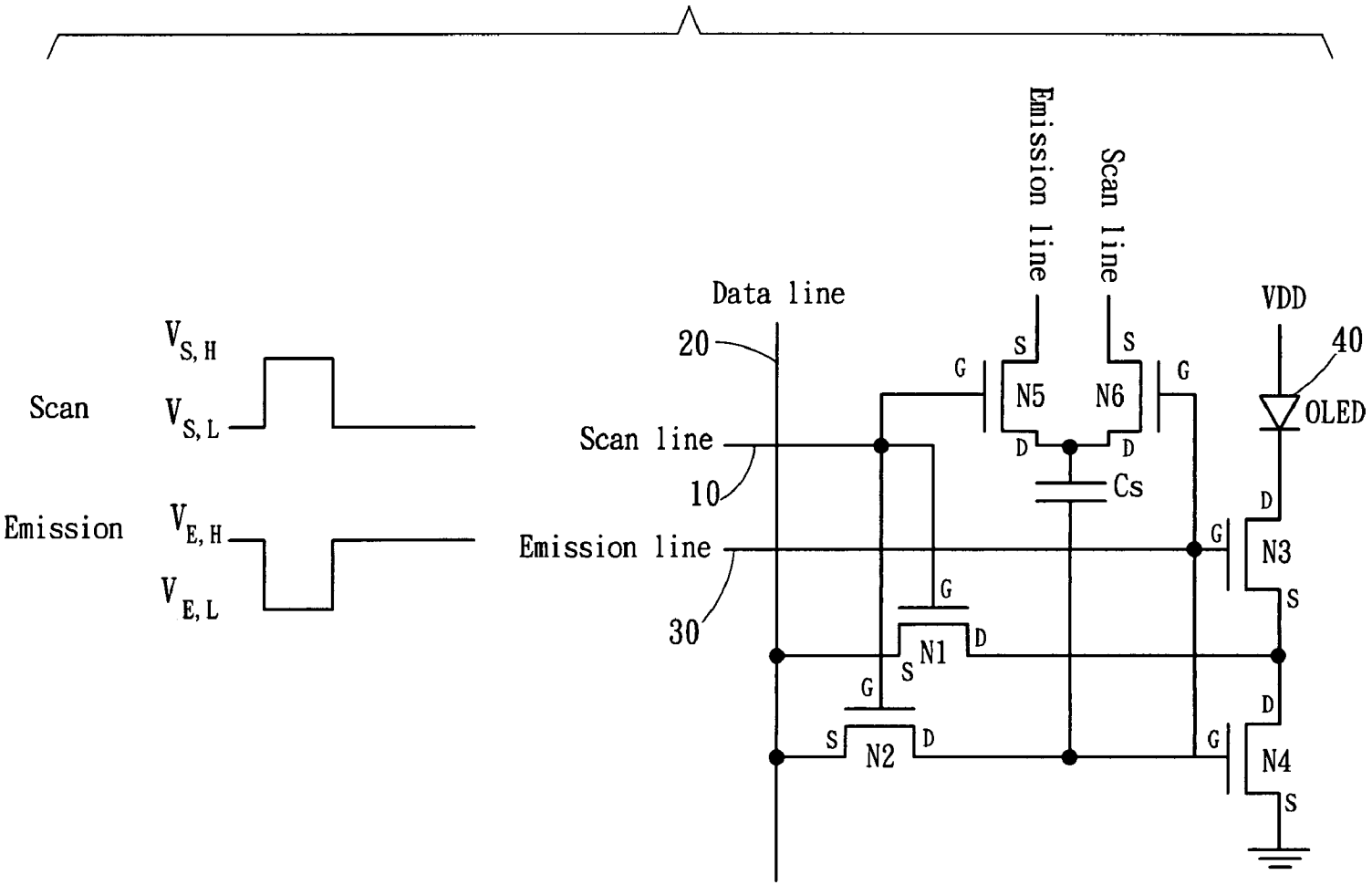
FIG. 6 is the circuit of a pixel in embodiment 6 in this invention.

Refer to FIG. 6 for the circuit of a pixel of embodiment 6 in this invention. As the Figure shows, the driving circuit of each pixel on the display panel includes one scan line 10 and one data line 20. The driving circuit in this embodiment is about the same as that in Embodiment 5; however, the only difference is source (S) of first switch transistor N5 connected to emission line 30 instead of first voltage supply V1 and source (S) of second switch transistor N6 connected to scan line 10 instead of second voltage supply V2.

Actuation procedures of Embodiment 6 are described as follows:

1. When the systems scans the nth scan line 10, the potential is high ($V_{S,H}$), leading first scan transistor N1, second scan transistor N2 and first switch transistor N5 to become on. As the potential of the nth emission line 30 is low ($V_{E,L}$), connect transistor N4 and second switch transistor N6 are OFF. Thus, no current will pass through luminescence device 40 to prevent writing mistakes to the storage capacitor Cs.

One end of storage capacitor Cs connected to gate of driving transistor N3 links up with data line 20 through second scan transistor N2 and the other end is connected to nth emission line 30 via first switch transistor N5. Meanwhile, part of data current ($I_{Data}$) of data line 20 charges/discharges storage capacitor Cs through first scan transistor N1 and first switch transistor N5. Gate voltage ($V_{g3}$) of driving transistor N3 equals low voltage of nth emission line 30 less that of storage capacitor Cs ($V_{CS}$); i.e., $V_{g3}=V_{E,L}+V_{Cs}$.

Consequently, drive current ($I_{Drive}$) passing through driving transistor N3 is as follows: $I_{Drive}=(1/2)\times\beta\times(V_{gs3}-V_{th3})^2$ (β as trans-conductance parameter of driving transistor N3 and source gate voltage of driving transistor N3, $V_{gs3}=V_{g3}=V_{E,L}+V_{CS}$. Hence, data current ($I_{Data}$) equals current passing through storage capacitor Cs ($I_{CS}$) plus drive current ($I_{Drive}$) passing through driving transistor N3; i.e., $I_{Data}=I_{CS}+I_{Drive}$.

2. Voltage of storage capacitor Cs ($V_{CS}$) makes drive current ($I_{Drive}$) passing through driving transistor N3 the same as data current ($I_{Data}$) of data line 20; that is, $I^{Data}=I_{Drive}=(1/2)\times\beta\times(V_{gs3}-V_{th3})^2$ and $V_{gs3}=V_{g3}=V_{E,L}+V_{CS}$. Data write is completed at the moment and voltage of storage capacitor Cs, $V_{CS}=(2\times I_{Data}/\beta)^{(1/2)}-(V_{E,L}-V_{th3})$.

3. Last, when potential of the nth scan line 10 changes from high ($V_{S,H}$) to low ($V_{S,L}$), first scan transistor N1, second scan transistor N2 and first switch transistor N5 are off. Meanwhile, potential of the nth emission line 30 changes from low ($V_{E,L}$) to high ($V_{E,H}$), leading connect transistor N4 and second switch transistor N6 to become on.

One end of storage capacitor Cs is connected to gate (G) of driving transistor N3 and the other end to scan line 10 via second switch transistor N6. Thus, gate (G) voltage ($V_{g3}$) of driving transistor N3 is $V_{S,L}+V_{Cs}$. Drive current passing through driving transistor N3 is as follows: $I^{Drive}=(1/2)\times\beta\times(V_{gs3}-V_{th3})^2$ and $V_{gs3}=V_{g3}=V_{S,L}+V_{CS}$. Luminescence device 40 is illuminated as drive current ($I_{Drive}$) passes through it via connect transistor N4.

In summary, the relationship between data current ($I_{Data}$) and drive current ($I_{Drive}$) is shown as $I_{Drive}=(1/2)\times\beta\times[(2\times I_{Data}/\beta)^{(1/2)}+V_{S,L}-V_{E,H}]^2$.

According to the above theory and formula, current output to luminescence device 40 is only related to data current ($I_{Data}$) written and not the threshold voltage (Vth) of driving transistor N3. As a result, threshold voltage difference resulted from process factors can be compensated.

In addition, voltage differences between scan line 10 ($V_{S,L}$) low level voltage and emission line 30 ($V_{E,L}$) low level voltage causes an offset at the gate of driving transistor N3. If the voltage of scan line 10 ($V_{S,L}$) is less than that of emission line 30 ($V_{E,L}$), larger data current ($I_{Data}$) may be imported by small drive current ($I_{Drive}$) at low gray scale to reduce the long charging time of storage capacitor Cs and parasitical capacitor.

Embodiment 7

Figure 7:
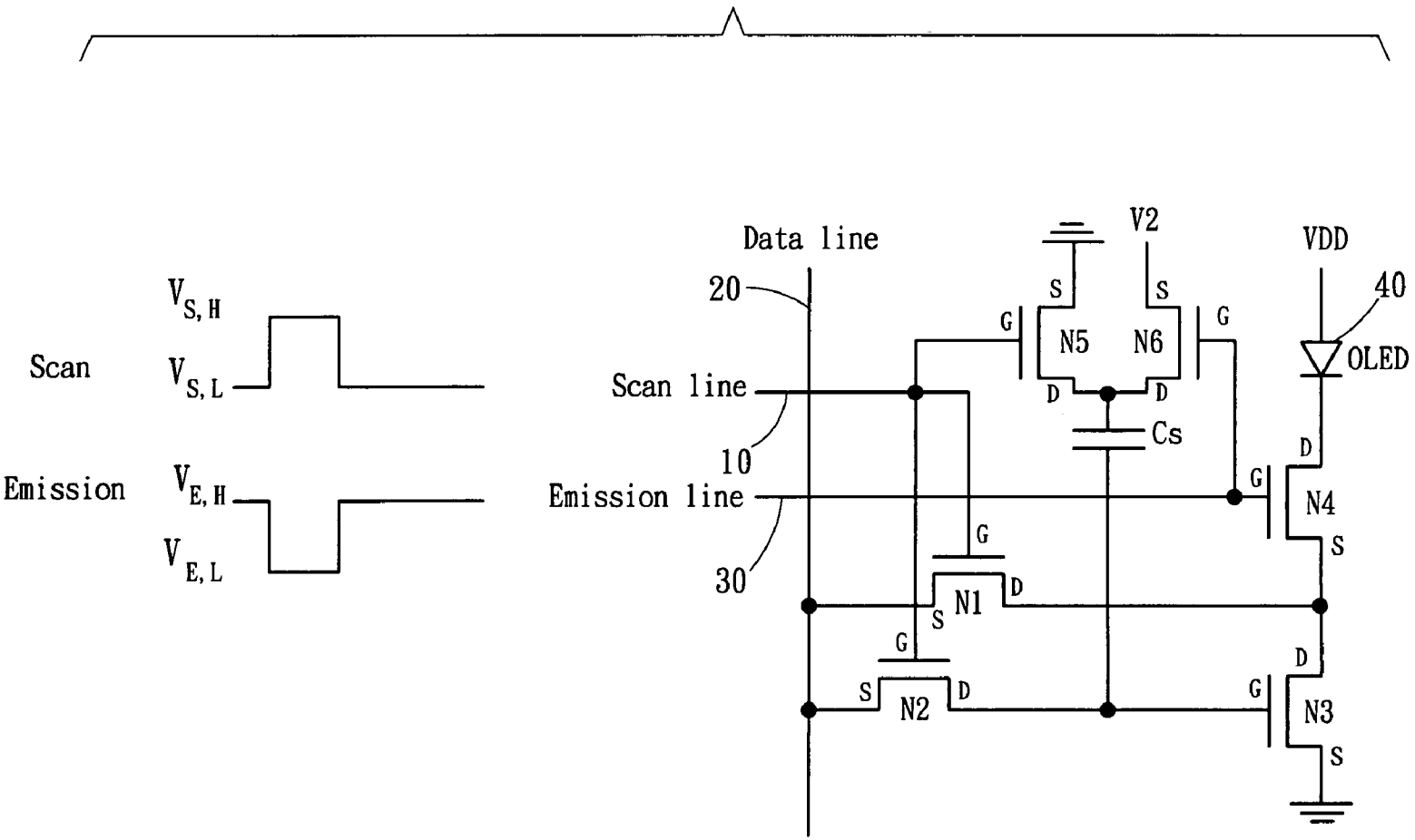
FIG. 7 is the circuit of a pixel in embodiment 7 in this invention.

Refer to FIG. 7 for the circuit of a pixel of embodiment 7 in this invention. As the Figure shows, the driving circuit of each pixel on the display panel includes one scan line 10 and one data line 20. The driving circuit in this embodiment is about the same as that in Embodiment 5; however, the only difference is source (S) of first switch transistor N5 grounded instead of connecting to first voltage supply V1 and source (S) of second switch transistor T6 still connected to second voltage supply V2 as in Embodiment 5.

Actuation procedures of Embodiment 7 are described as follows:

1. When the systems scans the nth scan line 10, the potential is high ($V_{S,H}$), leading first scan transistor N1, second scan transistor N2 and first switch transistor N5 to ON. As the potential of the nth emission line 30 is low ($V_{E,L}$), connect transistor N4 and Second switch transistor N6 are off. Thus, no current will pass through luminescence device 40 in this phase to prevent writing mistakes to the storage capacitor Cs.

One end of storage capacitor Cs connected to gate of driving transistor N3 links up with data line 20 through second scan transistor N2 and the other end is grounded via first switch transistor N5. Meanwhile, part of data current ($I_{Data}$) of data line 20 charges/discharges storage capacitor Cs through first scan transistor N1 and first switch transistor N5. Gate voltage ($V_{g3}$) of driving transistor N3 equals voltage of storage capacitor Cs ($V_{CS}$); i.e., $V_{g3}=0+V_{Cs}$.

Consequently, drive current ($I_{Drive}$) passing through driving transistor N3 is as follows: $I_{Drive}=(1/2)\times\beta\times(V_{gs3}-V_{th3})^2$ (β as trans-conductance parameter of driving transistor N3 and source gate voltage of driving transistor N3, $V_{gs3}=V_{g3}=0+V_{CS}$. Hence, data current ($I_{Data}$) equals current passing through storage capacitor Cs ($I_{CS}$) plus drive current ($I_{Drive}$) passing through driving transistor N3; i.e., $I_{Data}=I_{CS}+I_{Drive}$.

2. Voltage of Storage Capacitor Cs ($V_{CS}$) makes drive current ($I_{Drive}$) passing through Driving transistor N3 the same as data current ($I_{Data}$) of Data Line 20; that is, $I_{Data}=I_{Drive}=(1/2)\times\beta\times(V_{gs3}-V_{th3})^2$ and $V_{gs3}=V_{g3}=0+V_{CS}$. Data write is completed at the moment and voltage of storage capacitor Cs, $V_{CS}=(2\times I_{Data}/\beta)^{(1/2)}-(0-V_{th3})$.

3. Lastly, when the potential of the nth scan line 10 changes from high ($V_{S,H}$) to low ($V_{S,L}$), first scan transistor N1, second scan transistor N2 and first switch transistor N5 are off. Meanwhile, potential of the nth emission line 30 changes from low ($V_{E,L}$) to high ($V_{E,H}$), leading connect transistor N4 and second switch transistor N6 to become on.

One end of storage capacitor Cs is connected to gate (G) of driving transistor N3 and the other end to second voltage supply V2 via second switch transistor N6. Thus, gate voltage ($V_{g3}$) of driving transistor N3 is $V2+V_{Cs}$. Drive current passing through driving transistor N3 is as follows: $I_{Drive}=(1/2)\times\beta\times(V_{gs3}-V_{th3})^2$ and $V_{gs3}=V_{g3}=V2+V_{CS}$. Luminescence device 40 is illuminated as drive current ($I_{Drive}$) passes through it via connect transistor N4.

In summary, the relationship between data current ($I_{Data}$) and drive current ($I_{Drive}$) is shown as $I_{Drive}=(1/2)\times\beta\times[(2\times I_{Data}/\beta)^{(1/2)}+V2-0]^2=(1/2)\times\beta\times[(2\times I_{Data}/\beta)^{(1/2)}+V2]^2$.

According to the above theory and formula, current output to luminescence device 40 is only related to data current ($I_{Data}$) written, not threshold voltage (Vth) of driving transistor N3. As a result, threshold voltage difference resulted from process factors can be compensated.

In addition, voltage difference between second voltage supply V2 and grounding (0) causes an offset at the gate of driving transistor N3. If voltage of second voltage supply V2 is less than that of grounding (0), larger data current ($I_{Data}$) may be imported by small drive current ($I_{Drive}$) at low gray scale to reduce long charging time of storage capacitor Cs and parasitical capacitor.

Embodiment 8

Figure 8:
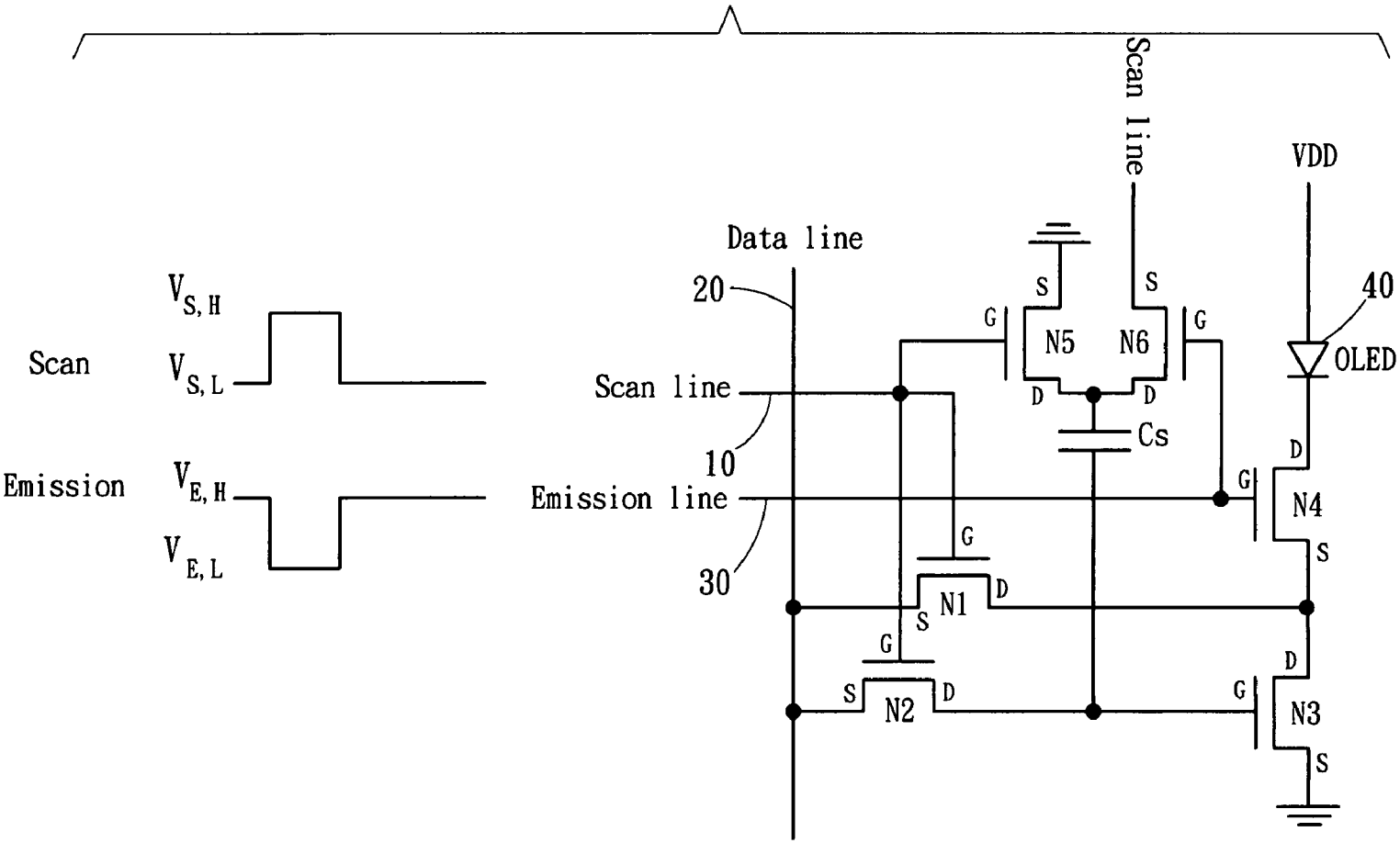
FIG. 8 is the circuit of a pixel in embodiment 8 in this invention.

Refer to FIG. 8 for the circuit of a pixel of embodiment 8 in this invention. As the Figure shows, the driving circuit of each pixel on the display panel includes one scan line 10 and one data line 20. The driving circuit in this embodiment is about the same as that in Embodiment 6; however, the only difference is source (S) of first switch transistor N5 is grounded instead of connecting to emission line 30 and source (S) of second switch transistor T6 still connected to scan line 10 as in Embodiment 6.

Actuation procedures of Embodiment 8 are described as follows:

1. When the systems scans the nth scan line 10, the potential is high ($V_{S,H}$), leading first scan transistor N1, second scan transistor N2 and first switch transistor N5 to become on. As the potential of the nth emission line 30 is low ($V_{E,L}$), connect transistor N4 and second switch transistor N6 are OFF. Thus, no current will pass through luminescence device 40 in this phase to prevent writing mistakes to the storage capacitor Cs.

One end of storage capacitor Cs connected to gate of driving transistor N3 links up with data line 20 through second scan transistor N2 and the other end is grounded via first switch transistor N5. Meanwhile, part of data current ($I_{Data}$) of data line 20 charges/discharges storage capacitor Cs through first scan transistor N1 and first switch transistor N5. Gate voltage ($V_{g3}$) of driving transistor N3 equals voltage of storage capacitor Cs ($V_{CS}$); i.e., $V_{g3}=0+V_{Cs}$.

Consequently, drive current ($I_{Drive}$) passing through driving transistor N3 is as follows: $I_{Drive}=(1/2)\times\beta\times(V_{gs3}-V_{th3})^2$ ($\beta$ as trans-conductance parameter of driving transistor N3 and source gate voltage of driving transistor N3, $V_{gs3}=V_{g3}=0+V_{CS}$. Hence, data current ($I_{Data}$) equals current passing through storage capacitor Cs ($I_{CS}$) plus drive current ($I_{Drive}$) passing through driving transistor N3; i.e., $I_{Data}=I_{CS}+I_{Drive}$.

2. Voltage of storage capacitor Cs ($V_{CS}$) makes drive current ($I_{Drive}$) passing through driving transistor N3 the same as data current ($I_{Data}$) of data line 20; that is, $I_{Data}=I_{drive}=(1/2)\times\beta\times(V_{gs3}-V_{th3})^2$ and $V_{gs3}=V_{g3}=0+V_{CS}$.

Data write is completed at the moment and voltage of Storage Capacitor Cs, $V_{CS}=(2\times I_{Data}/\beta)^{(1/2)}-(0-V_{th3})$.

3. Lastly, when potential of the nth Scan Line 10 changes from high ($V_{S,H}$) to low ($V_{S,L}$), first scan transistor N1, second scan transistor N2 and first switch transistor N5 are OFF. Meanwhile, potential of the nth emission line 30 changes from low ($V_{E,L}$) to high ($V_{E,H}$), leading connect transistor N4 and second switch transistor N6 to ON.

One end of storage capacitor Cs is connected to gate of driving transistor N3 and the other end to nth scan line 10 via second switch transistor N6. Thus, gate voltage ($V_{g3}$) of driving transistor N3 is $V_{S,L}+V_{Cs}$. Drive current passing through driving transistor N3 is as follows: $I^{Drive}=(1/2)\times\beta\times(V_{gs3}-V_{th3})^2$ and $V_{gs3}=V_{g3}=V_{S,L}+V_{CS}$. Luminescence device 40 is illuminated as drive current ($I_{Drive}$) passes through it via connect transistor N4.

In summary, the relationship between data current ($I_{Data}$) and drive current ($I_{Drive}$) is shown as $I_{Drive}=(1/2)\times\beta\times[(2\times I_{Data}/\beta)^{(1/2)}+V_{S,L}-0]^2=(1/2)\times\beta\times[(2I_{Data}/\beta)^{(1/2)}+V_{S,L}]^2$.

According to the above theory and formula, current output to luminescence device 40 is only related to data current ($I_{Data}$) written, not threshold voltage (Vth) of driving transistor N3. As a result, threshold voltage difference resulted from process factors can be compensated.

In addition, voltage difference between scan line 10 ($V_{S,L}$) low level voltage and grounding (V=0) causes an offset at the gate of driving transistor N3. If voltage of scan line 10 ($V_{S,L}$) is less than that of grounding (0), larger data current ($I_{Data}$) may be imported by small drive current ($I_{Drive}$) at low gray scale to reduce long charging time of storage capacitor Cs and parasitical capacitor.

To conclude, the Active Matrix Display Driving Circuit presented by this invention has the following advantages:

1. In comparison with the U.S. Pat. Nos. 6,373,454 and 6,229,506, the ratio of input current to output current in this invention can be shown as: output current=A×input current+B. It solves long charging/discharging time efficiently.

2. In comparison with the U.S. Pat. Nos. 6,359,605, 6,501,466 and 6,535,185, the correlation between input current and output current (output current=A×input current+B) is based on capacitive coupling, not the structure of current mirror. The issue of matching TFT elements is not considered necessary. Consequently, influential process factors are reduced and the yield of panels increases.

3. In comparison with the above patented circuits, capacitive coupling exactly ensures source gate voltage (Vgs) of the driving transistor be smaller than threshold voltage (Vth), which generates no current for the driving transistor. In this way, the luminescence device won't be illuminated and a higher contrast is developed.

4. To compare with the thesis published by Samsung with the subject of A New Current Programmable Pixel Structure for large-Size and High-Resolution AMOLEDs (International Display Workshops 2002 (IDW 2002)):

a. As only one capacitor is applied to achieve the correlation (output current=A×input current+B) in this invention, voltage of capacitive coupling does not change with relative values of two capacitors due to process or/and layout effect, and driving transistor affect the driving current. Consequently, influential process factors are reduced and the yield of panels increases.

b. As one capacitor and two levels are used to achieve the correlation (output current=A×input current+B) in this invention instead of capacitive coupling by two capacitors, precision of the capacitor is not required. Hence, influential process factors are reduced and the yield of panels increases.

c. Since merely one capacitor is utilized to achieve the correlation (output current=A×input current+B) in this invention, a higher aperture ratio is developed.

5. In comparison with general voltage driving circuits, this invention is a current driving circuit that solves the problem of different properties of TFT elements and compensates threshold voltage (Vth) difference and mobility automatically.

6. To compare with voltage driving circuits, the current driving circuit in this invention can solve the IR drop problem of the voltage supply line.

What is claimed is:

1. An active matrix display driving circuit is disclosed and a driving circuit of each pixel on a display panel includes:

a first scan transistor and a second scan transistor, the gates (G) of the first scan transistor and second scan transistor connected to a scan line and sources (S) connected to a data line;

a driving transistor, the source (S) of the driving transistor connected to a voltage supply;

a connect transistor, the source (S) of the connect transistor connected to drains (D) of driving transistor and second scan transistor and gate (G) connected to an emission line;

a first switch transistor, the source (S) of the first switch transistor connected to a first voltage supply and gate (G) connected to a scan line;

a second switch transistor, the source (S) of the second switch transistor connected to a second voltage supply and gate (G) connected to the emission line;

a storage capacitor, one end of the storage capacitor connected to drains (D) of the first switch transistor and second switch transistor and the other end connected to drain (D) of the first scan transistor and gate (G) of the driving transistor;

a luminescence device, the anode of the luminescence device connected to drain (D) of the connect transistor and the cathode connected to the ground.

2. The active matrix display driving circuit according to claim 1, wherein the first scan transistor, second scan transistor, driving transistor, connect transistor, first switch transistor and second switch transistor are PMOS transistors.

3. The active matrix display driving circuit according to claim 1, wherein the luminescence device is an electroluminance device (EL device).

4. The active matrix display driving circuit according to claim 1, wherein the voltage of second voltage supply is greater than that of first voltage supply.

5. The active matrix display driving circuit according to claim 1, wherein the first voltage supply can be connected to the emission line and the second voltage supply can be connected to the scan line.

6. The active matrix display driving circuit according to claim 1, wherein the first voltage supply can be connected to voltage supply.

7. The active matrix display driving circuit according to claim 1, wherein the first voltage supply can be connected to voltage supply and the second voltage supply can be connected to the scan line.

8. An active matrix display driving circuit is disclosed and a driving circuit of each pixel on a display panel includes one scan line and one data line as follows:

a first scan transistor and a second scan transistor, the gates (G) of the first scan transistor and second scan transistor connected to a scan line and sources (S) connected to a data line;

a driving transistor, the source (S) of the driving transistor grounded;

a connect transistor, the source (S) of the connect transistor connected to drains (D) of driving transistor and first scan transistor and gate (G) connected to an emission line;

a first switch transistor, the source (S) of the first switch transistor connected to a first voltage supply and gate (G) connected to a scan line;

a second switch transistor, the source (S) of the second switch transistor connected to a second voltage supply and gate (G) connected to the emission line;

a storage capacitor, one end of the storage capacitor connected to drains (D) of the first switch transistor and second switch transistor and the other end connected to drain (D) of the second scan transistor and gate (G) of the driving transistor;

a luminescence device, the anode of the luminescence device connected to voltage supply and cathode connected to drain (D) of the connect transistor.

9. The active matrix display driving circuit according to claim 8, wherein the first scan transistor, second scan transistor, driving transistor, connect transistor, first switch transistor and second switch transistor are NMOS transistors.

10. The active matrix display driving circuit according to claim 8, wherein the luminescence device is an electroluminance device (EL device).

11. The active matrix display driving circuit according to claim 8, wherein the voltage of second voltage supply is less than that of first voltage supply.

12. The active matrix display driving circuit according to claim 8, wherein the first voltage supply can be connected to the emission line and the second voltage supply can be connected to the scan line.

13. The active matrix display driving circuit according to claim 8, wherein the first voltage supply can be grounded.

14. The active matrix display driving circuit according to claim 8, wherein the first voltage supply can be grounded and second voltage supply can be connected to the scan line.

* * * * *